US005664753A

United States Patent [19]

Takei

[11] Patent Number: 5,664,753

[45] Date of Patent: Sep. 9, 1997

[54] BOTTLE OR CONTAINER HOLDER FOR HOLDING THE BOTTLE OR CONTAINER IN AN INVERTED POSITION

[76] Inventor: Koji Takei, 629 N. Bundy Dr., Los Angeles, Calif. 90049

[21] Appl. No.: 502,055

[22] Filed: Jul. 14, 1995

[51] Int. Cl.[6] ..... A47K 1/08

[52] U.S. Cl. ..... 248/311.3; 248/146; 248/311.2; 248/314

[58] Field of Search ..... 248/146, 311.2, 248/311.3, 312, 314, 346.11

[56] References Cited

U.S. PATENT DOCUMENTS

| | | | |
|---|---|---|---|
| 1,603,954 | 10/1926 | Huston | 248/146 |
| 1,825,348 | 9/1931 | Gumsey | 248/312 |
| 2,784,577 | 3/1957 | Beaham, III | 248/146 |
| 2,963,256 | 12/1960 | Borah | 248/314 |
| 3,365,761 | 1/1968 | Kalvig | 248/314 |
| 3,698,675 | 10/1972 | Lerew et al. | 248/311.2 |
| 3,831,209 | 8/1974 | Clingman | 248/346.11 |
| 4,756,497 | 7/1988 | Lan | 248/311.2 |
| 4,969,618 | 11/1990 | Thompson | 248/152 |
| 5,009,028 | 4/1991 | Lorenzana et al. | 248/311.3 |

*Primary Examiner*—Leslie A. Braun
*Assistant Examiner*—Anita M. King
*Attorney, Agent, or Firm*—McAulay Fisher Nissen Goldberg & Kiel, LLP

[57] ABSTRACT

A holder for supporting a bottle or container in an inverted position, wherein a member having substantially cylindrically-shaped outer configuration is provided with a receptacle opening for receiving a container cap or closure for holding and supporting the container in an inverted condition, and a pair of oppositely disposed facing surfaces, are provided with one facing surface forming a base on which the holder is adapted to rest on a support.

8 Claims, 3 Drawing Sheets

BOTTLE OR CONTAINER HOLDER FOR HOLDING THE BOTTLE OR CONTAINER IN AN INVERTED POSITION

BACKGROUND OF THE INVENTION

1. Field of the Invention

This invention relates to a bottle holder which includes a stand or support to hold a bottle or container. More particularly, the invention is concerned with an inverted bottle, container stand or support for holding a bottle or container in an inverted position so that the contents are rapidly withdrawn.

2. Description of the Prior Art

Supports for bottles or containers both in their normal upright position or in an inverted condition for transport are known. Such supports are primarily concerned with a support or other type of transportation device such as a transport which is primarily intended to avoid damage to the bottle or container as well as to provide for an increased quantity of the articles in the transporter.

Certain transporters invert each adjacent bottle so that an increased quantity of the bottles can be transported in the same volume transporter. When the outer container is not of uniform size both axially and transversely, such containers can also be transported in an inverted condition to provide for increased quantity of container transport within the same volume of the transporter.

SUMMARY OF THE INVENTION

A purpose of the invention is to obtain the last drop of the contents contained in the container.

The invention is directed to a bottle or container holder for support thereof in an upside-down condition to support the container by means of the cap and thereby avoid any markings on a counter or rest-support area due to the container producing a rust area or other deleterious or unwanted markings.

In some instances, when the container or bottle contains a heavy liquid such as lotion, detergent or shampoo, it is difficult to extract the last drop. With this invention the problem is solved since the contents are already at the mouth of the container when the container is opened.

One of the features of the invention is to provide a free-standing stand for a bottle or container which can support the bottle or container in an inverted condition.

Another feature of the invention is to provide a support for holding or supporting a container in an inverted condition and which is attachable to a wall or other member.

To these ends, the present invention consists in the provision of a holder for supporting a bottle or container in an inverted position and includes a pair of oppositely disposed facing surfaces, at least one of the facing surfaces being perpendicular to a longitudinal axis of a cylindrically-shaped outer configuration, one of the facing surfaces forming a base surface on which the stand is adapted to rest on a support, and a receptacle opening being provided in the cylindrically-shaped member for receiving a cap or closure of a container for holding and supporting the container in the inverted position thereof so that the contents of the container will move towards the cap for the container and permit the last drop of the contents to be extracted from the container.

DESCRIPTION OF THE PREFERRED EMBODIMENTS

Figure 1:
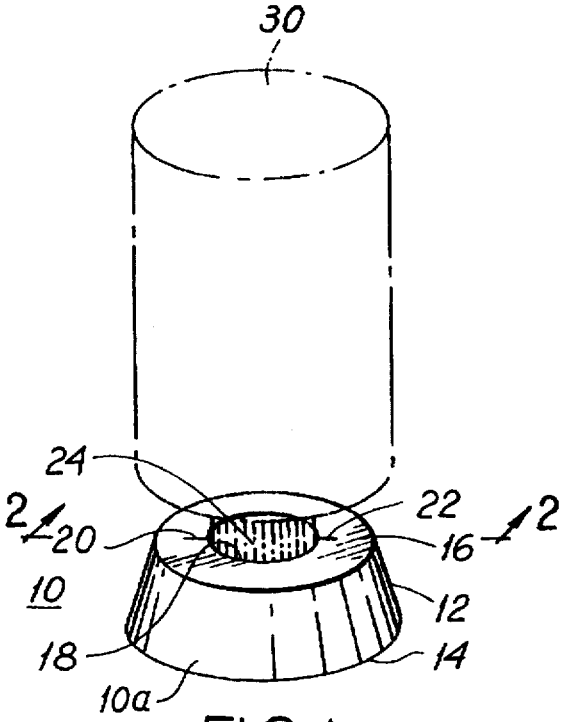
FIG. 1 is a perspective view of one embodiment of a holder for holding a bottle or container in an inverted position according to the invention with a container shown in phantom outline.
Figure 2:
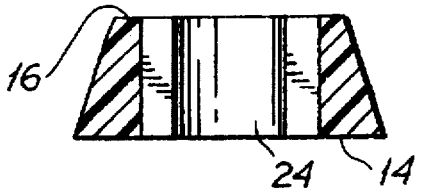
FIG. 2 is a sectional view taken on line 2—2 of FIG. 1.
Figure 6:
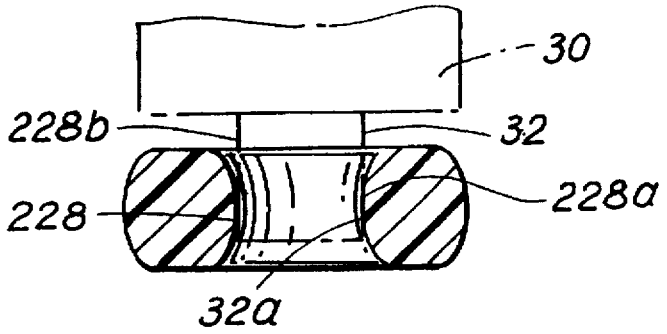
FIG. 6 is a sectional view of another embodiment of the holder according to the invention with a bottle or container in an inverted condition shown in phantom outline.

Referring now more particularly to FIGS. 1 and 2 of the drawings which shows one embodiment of a holder 10 in the form of a support 10*a* of the invention and comprises a generally cylindrically or cylindraceously-shaped member and as shown in FIGS. 1 and 2, a substantially trapezoidally shaped support outer wall element 12 with a lower base portion 14 and an upper base portion 16 in which the diameter of base portion 14 is greater than the diameter of base portion 16. Base portion 14 in the trapezoidal configuration forms the major base and base portion 16 forms the minor base. Positioned between lower base portion or major base 14 and upper base portion 16 is a holding portion or minor base 18 defined by a cylindrical wall. Holder 10 is provided with a pair of longitudinal slits 20, 22 which surround the holding portion and which extend transversely to a central opening 24 within holding portion 18 and substantially parallel to a longitudinal axis of central opening 24. The central opening 24 is surrounded by a substantially cylindrical wall 18 shown as a right circular cylinder. Bottle or container 30 shown in phantom outline is provided with a closure or cap 32, as best seen in FIG. 6 is received within central cylindrical opening 24, surrounded by wall 18 which defines the holding portion and is maintained in a tight-fitting upstanding relationship by holding portion 18 of holder 10 which surrounds central opening 24.

The holder 10 will maintain and support the container in an inverted upright condition so that the contents which is a liquid or a dense fluid will flow towards the mouth of the container and assist in removing the last drop of the contents without too long a waiting period.

Holder 10 in this embodiment is shown as a stand and is made from a resilient material which can expand slightly and central opening 24 because of slits 20, 22 can open to enable opening 24 to receive the container cap and yet provide a tight fit so as to maintain container 30 in an upright condition. Slits 20 and 22 will provide some degree of expansion of cylindrical opening 24 so as to widen the diameter of cylindrical opening 24 to expand cylindrical wall 18 to increase the diameter thereof to facilitate the insertion of cap 32 into the opening 24.

Figure 3:
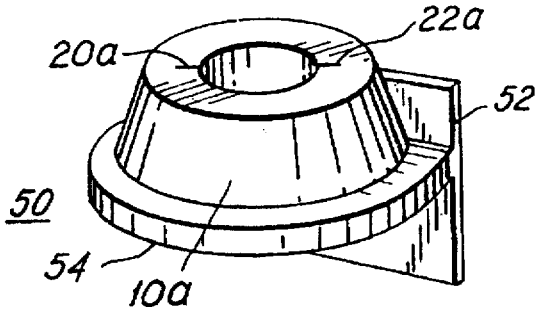
FIG. 3 is a perspective view of another embodiment of a holder including a back plate according to the invention.

Reference is made to FIG. 3 which shows holder 10 comprising support 10*a* combined with a wall mounting plate comprising a back plate 52 which can be made from a ceramic tile material so that it can be formed as part of a ceramic tile wall or from a suction-type of plastic material so that it can be applied by suction holding power to a wall. Back plate 52 is provided with a substantially perpendicular extension member 54 to which support 10*a* is connected. Support 10*a* can be made integral with back plate 52 and in particular if back plate 52 is fabricated from a plastic material which is adhered to the wall by a bonding agent. Support 10*a* can also be fabricated from a ceramic material and made integral with back plate 52. If the entire unit or holder 10 comprising support 10*a* and back plate 52 is made from a ceramic of other non-flexible type of material, then the slits 20 are omitted as they would serve no useful purpose because the ceramic would have no degree of expansion.

Figure 3A:
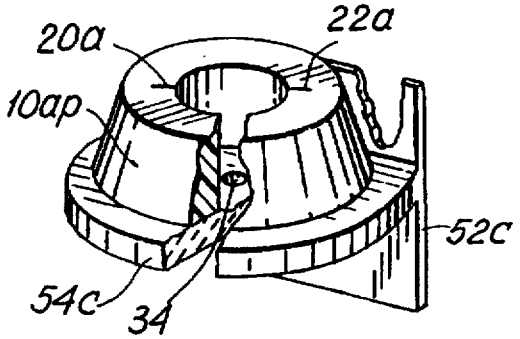
FIG. 3A is a perspective view with a broken away portion of the embodiment shown in FIG. 3 in which the back plate is made from ceramic and a support connected with the back plate is made from plastic and provided with slits.

Referring to FIG. 3A which shows back plate 52*c* made from a ceramic material and extension member 54*c* also made from a ceramic material. The upper portion 10*ap* which corresponds to support 10*a* has a trapezoidal outer configuration and is made from a plastic material and provided with longitudinal slits 20*a* and 22*a*.

Figure 3B:
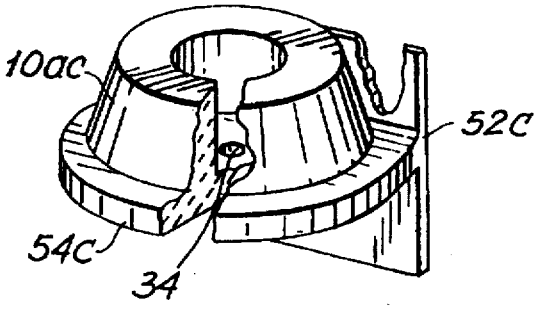
FIG. 3B is a perspective view of another embodiment of the holder according to the invention with a partially broken away portion showing the support and back plate made from a ceramic material and the slits are omitted.

In FIG. 3B, the entire unit is made from a ceramic material so that support 10*ac* is unitary with base 54*c* also made from ceramic material and forming a unitary whole with ceramic back plate 52*c* so that it can be used as a wall plate.

Extension member 54*c* which forms a bottom or base is provided with a drain hole 34 so that should any moisture or liquid accumulate on the bottom, such liquid will drain off.

In the FIG. 3 embodiment, the entire unit can be formed from a ceramic material or the upper portion 10*a* forming part of stand 50 can be made from a flexible plastic material and when made from a flexible plastic material, slits 20*a* and 22*a* are provided, and when made from a ceramic material, the slits would not be used.

Figure 4:
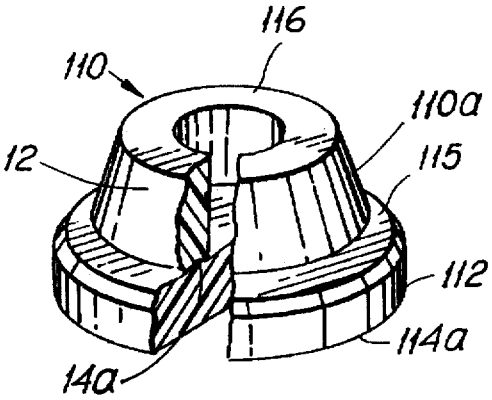
FIG. 4 is a perspective view of another embodiment of the holder according to the invention formed of a plastic base and a ceramic support.

Reference is now made to FIG. 4 which shows a holder 110 including a support 110*a*, which is a modified form of the support 10*a* in FIGS. 1 and 2, and wherein like parts are designated with the same number raised by 100. Accordingly holder 110 includes an upper portion 110*a* having a trapezoidal shape and a lower portion or support base 112 having a substantially cylindrical outer contour. Lower portion or base 112 is provided with a substantially flat base portion 114*a* to rest on a substantially flat surface and on upper portion 115 on which base 14*a* of upper portion is on. The upper surface 116 omits the slits, because the entire unit is made from a ceramic material.

Figure 4C:
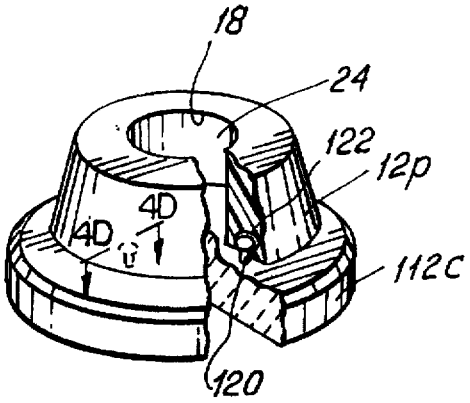
FIG. 4C is a sectional view showing another embodiment in which the base is made from a ceramic material and the support is made from a plastic material and in which the support and base can be readily attached and detached from each other.
Figure 4A:
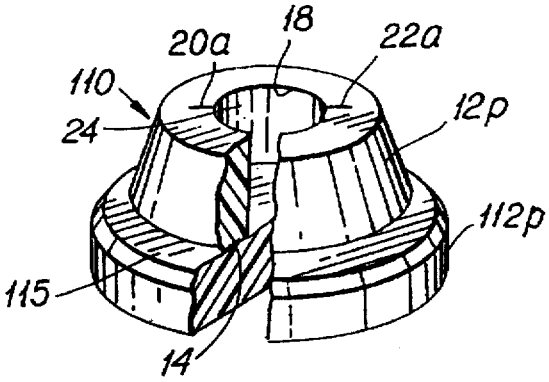
FIG. 4A shows a partial perspective view, partially cut away of a modification of the embodiment shown in FIG. 4 in which the entire end is made from a plastic material.

In FIG. 4A, the lower portion or support base 112*p* and the upper portion 12*p* are both made from a plastic material, and the upper portion 12*p* includes the slits 20*a* and 22*a*. Support base 112*p* can be formed from a suction material so that it will adhere to the surface on which it rests.

Figure 4D:
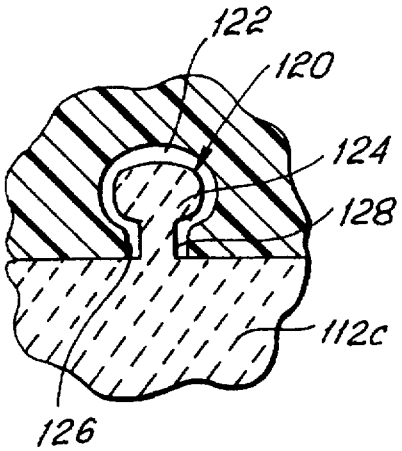
FIG. 4D is an enlarged sectional view of a portion of FIG. 4C.
Figure 4B:
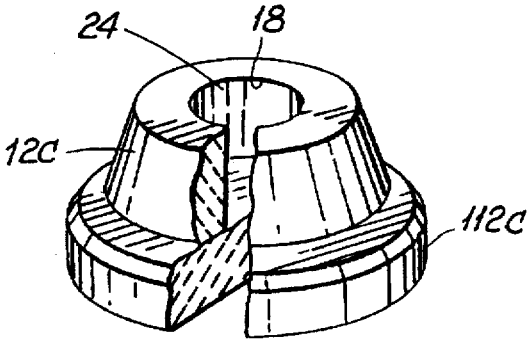
FIG. 4B is a perspective view partially cut-away to show the entire unit made from a ceramic material.

In FIG. 4B, the entire unit is formed from a ceramic material and support base 112*c* and the upper portion 12*c* which is the container cap holding portion are both made from a ceramic material. In this embodiment, since the container cap holding portion 18 surrounding opening 24 is a ceramic material, no slits are provided.

Referring to FIG. 4C which shows upper portion 12*p* made from a plastic or rubber foam material and a support base 112*c* made from a ceramic material and made from units which can be readily connected and disconnected from each other. For this purpose, base 112*c* (see FIG. 4D) includes connectors 120 which are received within openings 122 in upper portion 12*p*. The openings 122 spread to receive the caps 124 within U-shaped type openings 122 and includes a portion 126 which overlies the shank 128 of connectors 120.

Figure 5:
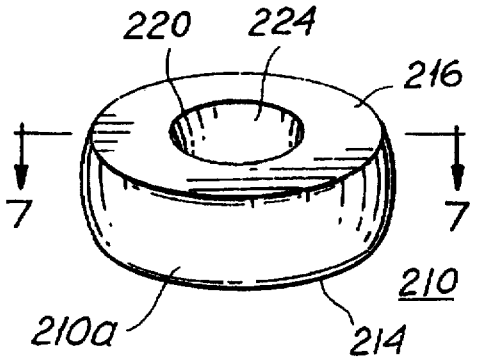
FIG. 5 is a perspective view of another embodiment of the holder according to the invention showing a torroidal-shape support.

Reference is made to FIGS. 5 and 6 and in particular, holder 210 which includes support 10*a* and two substantially parallel facing surfaces 214 and 216 and is provided with a central opening 224. Holder 210 includes a generally torroidally-shaped surface with an outer curved surface 210*a* and an outwardly curved inner surface 228 surrounding central opening 224 which provides for a gripping portion to grip the cap 32 of container 30.

Outwardly curved inner surface 228 includes a first portion 228*a* which is in direct pressure relationship contact with the outer surface portion of outer cylindrical surface 32*a* of cap 32, and a second portion 228*b* which is spaced from cap 32 to facilitate the insertion of cap 32 into opening 224.

Cap 32 is usually made from a non-flexible resilient material so that if a tight fit is to be provided between first portion 228*a* and cap 32, stand 220 is preferably made from a flexible resilient material to provide for ease of insertion of cap 32 into opening 224.

In the embodiments shown in FIGS. 5 and 6, the inner surface 224 can be made as a right circular cylinder surrounding opening 224 in a manner similar to cylindrical wall 16 of FIGS. 1 and 2.

Figure 7:
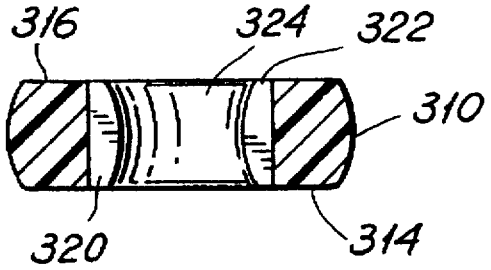
FIG. 7 is a sectional view taken on line 7—7 of FIG. 5 of another embodiment of a holder according to the invention.

Reference is made to FIG. 7 which shows a holder 310 and is a modification of holder 210 in FIGS. 5 and 6. In this embodiment parts similar to the parts in FIGS. 5 and 6 have been numbered with the prefix 300 and not 200. Accordingly, this embodiment adds slits 320 and 322 which perform the same function as slits 20 and 22 in the FIGS. 1 and 2 embodiment. In this embodiment, the central opening 324 can be made in the form of a right circular cylinder, as 18 in FIGS. 1 and 2 or it can have a first portion such as 228*a* and a second portion 228*b* as in the FIGS. 5 and 6 embodiment. In addition, it includes lower base portion 314 and upper base portion 316.

Figure 8:
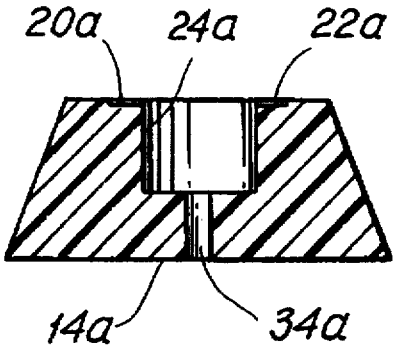
FIG. 8 is a sectional view of another embodiment.

Referring now more particularly to FIG. 8 which is a modification of the FIGS. 1 and 2 embodiment and which is similar to the FIGS. 1 and 2 embodiment, holder 10 in addition includes a base portion 14*a* and opening 24*a* is a substantially U-shaped opening in order to receive cap 32.

Top portion 16*a* can be provided with slits 20*a* and 22*a*. In addition base 14*a* can also be provide with an opening 34*a* to act as a drain hole.

This particular modification can be used with all of the other embodiments to provide for a closed base portion and a U-shaped opening to receive cap 32. Such a modification may be particularly useful in a situation where one does not wish to mar the countertop on which the sand rests. Also, it is useful for those embodiments where the stand is attached to a wall and it is desired to prevent drippings from the container if the cap 32 is not tightly closed.

Figure 9:
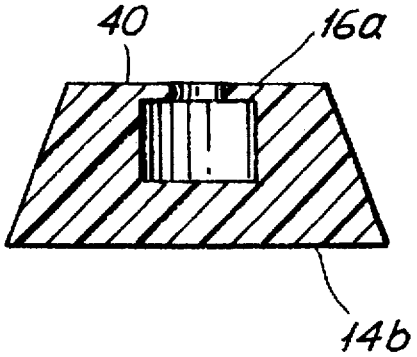
FIG. 9 is a sectional view of another embodiment of a holder according to the invention.

Referring now to FIG. 9 which shows a modification of holder 10 and includes a closed bottom **14*b* for the support, and in which there is a circumferentially extending upper lip portion 40. This lip portion is useful to provide for a gripping action on the side of cap 32 (not shown). The top portion 16*a* omits the slits and upper lip portion 40 which can be considered to be an internal type bumper provides for the holding action between the stand and the cap 32** of the container.

While bottom **14*b* is shown with a closed bottom it can also be provided with a drain hole 34*a* of the type shown in FIG. 8**.

While reference has generally been made to a generally-cylindrically-shaped member or a member having trapezoidally-shaped cylindrical outer-surface configuration, the outer circumferential extent when taken as a cross-section to a longitudinal axis can also have a rectangular or square-shaped substantially cylindrical configuration while the trapezoidally-shaped configuration is preferred, other outer shapes are equally suitable. It should be noted that what is important is that the stand can support a bottle in an inverted configuration and supported by the cap or closure end.

The general outer configuration of the holder can provide any suitable outer configuration just so long as the outer configuration does not tip over when supporting a container or bottle. The base and stand can be placed within a medicine cabinet or it can be used on the outside on a counter top as well as placed onto a wall or form part of a ceramic tile when used in an environment having ceramic tiles.

It will be evident to those skilled in the art that different changes can be made to insure that the last drop of liquid contents is drained from the bottom or container once the cap is removed because the bottle or container has been in an inverted position to assure that the contents due to gravity is at the closest proximity possible to the exit portion of the container or bottle.

While there has been shown what is presently considered to be the preferred embodiments of the invention, it will be obvious to those skilled in the art that various changes and modifications may be made therein without departing from the scope of the invention.

I claim:

1. A holder for supporting a bottle or container provided with a cap or closure in an inverted position by engaging the cap or closure so that the contents of the container when in said inverted position will flow towards the mouth of the container, comprising:

a member having a substantially cylindrically-shaped outer configuration;

a pair of oppositely disposed facing surfaces, at least one of said facing surfaces being perpendicular to a longitudinal axis of said cylindrically-shaped outer configuration, said one facing surface forming a uniformly closed base surface on which said holder is adapted to rest on a support;

a receptacle opening in said cylindrically-shaped member including a receiving part for receiving and engaging solely the cap or closure of the container for holding said cap or closure and supporting said container upright in the inverted position thereof;

another facing surface of said pair of oppositely disposed facing surfaces forming a surface substantially coextensive with an entry portion to said receptacle opening;

an inwardly directed portion in said receiving part extending inwardly from said surface substantially coextensive with said entry portion to said receptacle opening to decrease an entry diameter of said receiving part for engaging the cap or closure of the container;

at least one slit extending from said receiving part partially towards an outer surface portion between said pair of oppositely disposed facing surfaces of said member to permit the diametrical extent of said receptacle opening to be increased; and said receiving part of said receptacle opening being a substantially U-shaped cylindrical opening with said closed surface forming a base for said substantially U-shaped cylindrical opening.

2. The holder according to claim 1, wherein said member has a trapezoidally-shaped outer configuration provided with a major base and a minor base, said major base forms a support for supporting the container in the inverted upright position and to assist in the prevention of tilting of the holder, said minor base and said major base being parallel to each other, and said receiving part extending from said other of said pair of oppositely facing surfaces and forming said minor base.

3. The holder according to claim 1, wherein said member is formed of plastic material and includes at least two slits extending from said entry portion of said receptacle opening partially towards said outer surface portion of said member to permit the diametrical extent of said receptacle opening to be increased while the other facing surface of said pair of oppositely disposed facing surfaces remains substantially planar and parallel to said one facing surface forming said closed base surface.

4. The holder according to claim 1, wherein said substantially U-shaped cylindrical opening includes a vertical inner surface forming a leg portion of said substantially U-shaped cylindrical connected with said base of said substantially U-shaped cylindrical opening, said leg portion forming a surround for engaging solely the cap or closure of the container.

5. The holder according to claim 4, wherein said vertical inner surface forming said leg portion of said substantially U-shaped cylindrical opening convexly-shaped outer surface to provide for a gripping action with the sides of the cap of the container.

6. The holder according to claim 1, wherein said substantially U-shaped cylindrical opening includes a vertical inner surface forming a leg portion of said substantially U-shaped cylindrical opening connected with said base of said substantially U-shaped cylindrical opening, said leg portion forming a substantially cylindrical surround for engaging solely the cap or closure of the container.

7. The holder according to claim 1, wherein said inwardly directed portion has a convexly-shaped outer surface for a gripping action with the sides of the cap or closure of the container.

8. The holder according to claim 1, further including a base on which said member rests and is supported, and said receiving part extends upwardly from said base for solely engaging the cap or closure of the container.

* * * * *